US007395618B2

(12) United States Patent
Jacobsen et al.

(10) Patent No.: US 7,395,618 B2
(45) Date of Patent: Jul. 8, 2008

(54) SUBSEA EXCAVATION AND SUCTION DEVICE

(75) Inventors: Tom Jacobsen, Trondheim (NO); Halvor Snellingen, Spydeberg (NO)

(73) Assignee: Fossura AS, Tustna (NO)

( * ) Notice: Subject to any disclaimer, the term of this patent is extended or adjusted under 35 U.S.C. 154(b) by 0 days.

(21) Appl. No.: 10/569,550

(22) PCT Filed: Aug. 30, 2005

(86) PCT No.: PCT/NO2004/000255

§ 371 (c)(1),
(2), (4) Date: Feb. 12, 2007

(87) PCT Pub. No.: WO2005/021878

PCT Pub. Date: Mar. 10, 2005

(65) Prior Publication Data

US 2007/0166107 A1 Jul. 19, 2007

(30) Foreign Application Priority Data

Sep. 1, 2003 (NO) ..... 20033872

(51) Int. Cl.
*E02F 3/88* (2006.01)

(52) U.S. Cl. ..... 37/313; 37/321; 37/322; 37/323; 37/324

(58) Field of Classification Search ..... 37/307, 37/313, 317, 319, 321, 322, 323, 324, 344; 405/248

See application file for complete search history.

(56) References Cited

U.S. PATENT DOCUMENTS

| | | | | |
|---|---|---|---|---|
| 2,952,083 | A | 9/1960 | Forkner | |
| 3,916,634 | A * | 11/1975 | Woodruff | 405/248 |
| 4,418,484 | A | 12/1983 | Wolters et al. | |
| 4,631,844 | A | 12/1986 | Deal | |
| 4,839,061 | A * | 6/1989 | Manchak Jr. et al. | 210/743 |
| 4,991,997 | A * | 2/1991 | Cowper | 405/73 |
| 5,970,635 | A | 10/1999 | Wilmoth | |
| 6,449,883 | B1 | 9/2002 | Vandycke | |
| 2004/0010947 | A1 | 1/2004 | Hutchinson et al. | |

FOREIGN PATENT DOCUMENTS

| | | |
|---|---|---|
| GB | 1262660 | 2/1972 |
| JP | 10-082271 | * 3/1998 |
| JP | 2004-316237 | * 11/2004 |

* cited by examiner

*Primary Examiner*—Gary S Hartmann
(74) *Attorney, Agent, or Firm*—Dennison, Schultz & MacDonald

(57) ABSTRACT

Subsea excavation and suction device includes a suction head with an inlet opening at an outer, free end and an outlet opening connected to a suction hose arranged at a distance from the inlet opening. The suction head is mounted on a hydraulic controller arm and at the inlet opening is provided with mechanical and hydraulic devices to disintegrate solid material (sediment). The hydraulic device includes a number of jet nozzles, while the mechanical device includes bars. The cross-sectional area of the inlet opening is larger than the cross-sectional area of the outlet opening.

23 Claims, 4 Drawing Sheets

SUBSEA EXCAVATION AND SUCTION DEVICE

This application is a filing under 35 USC 371 of PCT/NO2004/000255 filed Aug. 30, 2004.

The present invention concerns a device for subsea excavating and movement of solid material. More precisely it concerns a subsea excavating and suction device with a suction head with means to disintegrate solid material, mounted on a controllable arm

BACKGROUND OF THE INVENTION

When performing subsea operations there is often a need to move solid material, commonly denoted "bulk material" or "bulk". This may occur during leveling a terrain, trenching of ditches, embedment of pipes and cables or removal of ballast gravel. Corresponding needs may also occur in connection with work at or near a quay, harbour or dam installation.

In many cases the bulk material is comprised by compact silt, clay or other hard bulk materials which involves a number of challenges, primarily due to the hardness of the material which make it difficult to disintegrate.

At the same time the bulk material includes fine particles that lead to reduced visibility when dispersed or dissolved in water. Furthermore it may be a problem that the material is broken into rather blocks that are hard to move. These problems are added to high demands of precision with respect to the work performed, in order to e.g. avoid damage to fragile installations.

DESCRIPTION OF RELATED ART

U.S. Pat. No. 4,479,741 (Berti, 1982) describes a trencher, i.e. a device designed to remove sediment along a subsea pipe or penstock. The patent describes a full track type vehicle with preferably separate ejectors at each side of the pipe or penstock. The ejectors are intended to suck up and blow away sediment along the pipe or penstock in question. The ejectors have a mouthpiece that is telescopically extendable in a vertical direction and with a cross-sectional area that corresponds to the cross-sectional area of the hose or pipe through which the sediment will be blown.

Norwegian patent No. 311 639 (PCT/NO01/00142) discloses a device for the transportation of sediment, including comparatively large rocks, under water. The device comprises a belt or wheel based vehicle with an ejector powered suction hose, with a suction head arranged on a hydraulically controllable arm. A vital feature of this prior art device is the design of the suction hose or pipe with a substantially even cross-section throughout its length and that the inlet opening of the suction head under no circumstances must be larger than the mentioned cross-section, since this would involve a high risk of large particles getting stuck in the hose or pipe. It is indicated that the suction head may be furnished with nozzles to provide jet streams of water for loosening compact sediment/bulk material.

Norwegian patent application No. 2001 6361 (PCT/NO02/00491) describes a suction head for dredging with the characterizing feature of comprising two separate inlet openings, of which one is intended to suck up a mixture of sediment an d water while the other is arranged in a manner to avoid contact with the seafloor and therefore will suck in water only. The construction provides an automatic control of the suction power in the suction head dependent on the concentration of solid material that at each time is present, thereby minimizing the risk of blocking the suction head.

Furthermore there is known in the literature ROV based devices for subsea transportation or movement of solid material/sediment. The technical solutions related to the material transport for these devices generally follow one of the alternatives for movement of solid material mentioned above. There are e.g. known devices where so-called Zip pumps set up the suction force in a suction hose used for the purpose intended.

With respect to land based machines for moving bulk material, there have been suggested excavators with varying shapes and varying degrees of freedom for the scoop/grab, normally by means of hydraulically controlled manoeuvre arms. Vertical rotation about a horizontal axis is the most common movement for an excavator grab, but there are also embodiments that allow sideways rotation about a vertical axis and there are variants (Menzimuck) where one element of the manoeuvre arm is telescopic, allowing the grab to move back and forth along the telescopic axis. There are also for subsea use developed "simple" excavators intended for moving material strictly mechanically with a scoop or grab, not making use of jet nozzles or suction hoses/ejectors.

Common for all known devices for subsea mass or bulk transportation is a lack of versatility with respect to use for different purposes and for solid material of varying character. For tasks like moving substantial amounts of sediment or other solid material collected in a pile and comprising both loose rocks and particles of highly varying size on one hand and compact clay on the other hand, none of the prior art devices are particularly well suited.

SUMMARY OF THE INVENTION

The objective of the present invention is to provide a subsea excavating and suction device with a suction head that has an improved ability to disintegrate hard and ductile materials like clay, and which is able to move the loosened or excavated material a certain distance, e.g. to a subsea "land" fill.

It is a further objective of the invention that the device shall be versatile in the sense that it is capable of working with material of highly varying nature and efficient with respect to the volume capacity that it is able to excavate and move in a certain period of time.

It is a still further objective that excavation of fine grain particulate materials can be done in a manner with which the visibility in the water is not significantly reduced.

It is a still further objective of the invention that the device may be used for an exact shaping of the terrain, e.g. for leveling prior to installation of a sea floor structure, trenching of ditches, etc.

The invention makes it possible to "dig" quickly even in very compact clay and sediment/bulk material with varying nature and particle size. In order to achieve this the device according to the invention comprises a suction head mounted to an hydraulic arm, the suction head having an inlet opening with a cross-sectional area that is larger than the cross-sectional area of the suction hose through which the solid material is removed, while at the same time being provided with mechanical and hydraulic means to disintegrate the solid (bulk) material.

When e.g. used in compact clay the device according to the invention utilizes hydraulic means in the form of water jet nozzles, hereinafter dented primary jet nozzles, arranged along substantially the entire periphery f the inlet opening. These primary jet nozzles are preferably arranged in a diction substantially perpendicular to the inlet opening, and the liquid (water) from these jet nozzles will be able to cut through clay and other compact material and break loose pieces of same.

In order to have maximum utility of the water the inlet opening of the suction head is brought by means of the controller arm to a close contact with the material to be removed, so that the nozzle orifices are presses against or into the material. In this connection it is vital that the suction head is movably attached to the controller arm, preferably with several degrees of freedom of movement. It is particularly preferred that the suction head have the ability to rotate along an imaginary circle periphery.

In addition the suction head comprises mechanical means for disintegration of sediment/bulk material in the form of at least one rigid bar across the inlet opening, so that the suction head with an impact force may be pushed against the material to be disintegrated.

It is also, as previously mentioned, strongly preferred that the suction head and particularly whole or parts f the edges $\mathbf{6}_1$-$\mathbf{6}_4$ around the inlet opening is made in a material and with a thickness enabling it to function as a mechanical tool for disintegration of material to be removed. It is particularly preferred that whole or a part of the edges $\mathbf{6}_1$-$\mathbf{6}_4$ around the inlet opening is made with an extending edge or structure, generally with a wedge-like profile, and that the nozzles are integrated in such an extending edge.

With the characterizing features according to the invention one may, utilizing a suction head with a shape that is particularly adapted to the task in question and with a cross-sectional area that is larger than what is convenient to apply for the suction hose through which the material is to be removed, belabour the material hydraulically and mechanically to break loose e.g. clay. The fact that the primary jet nozzles may be forced into highly compact material enables the break-up of even very compact clay with a moderate water pressure. This ability is enhanced even more if the primary nozzles are integrated in or shaped as "teeth" or as a breaking, wedge-like edge that is able to penetrate the material in question.

The feature that the cross-sectional area is larger than and preferably significantly larger than the cross-sectional area of the suction hose that is used for conveying the material, allows a particularly quick excavation and material transportation. Such a solution requires, however, that a quick and efficient disintegration of sediment may be conducted, which as far as the inventors know, not has been possible to obtain hitherto.

DESCRIPTION OF THE PREFERRED EMBODIMENTS

Figure 1:
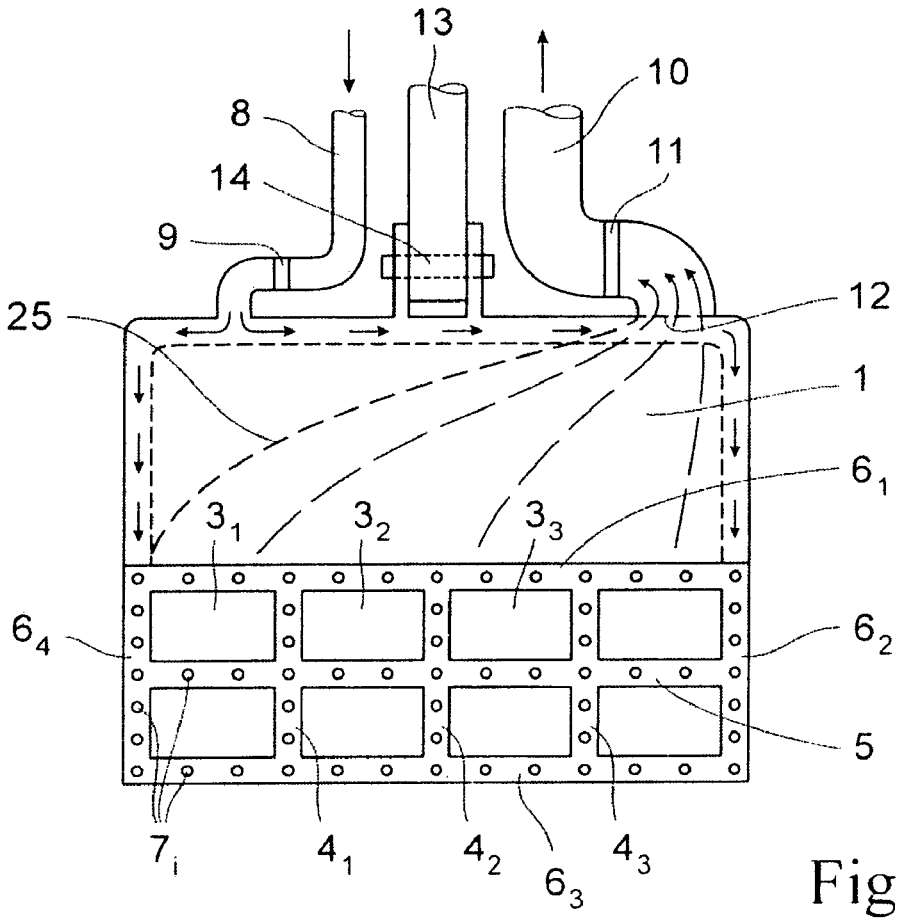
FIG. 1 is a front view of an excavation and suction device according to the present invention.

FIG. 1 is a schematic front view of a preferred embodiment of a suction head 1 that constitutes the central element of an excavating and suction device according to the present invention. At the outer, free end of the suction head (lowermost part of the drawing) the inlet opening 3 is shown divided in 8 mainly equal inlet sections $\mathbf{3}_1$-$\mathbf{3}_8$ (an arbitrary one designated $\mathbf{3}_i$) by three short bars $\mathbf{4}_1$-$\mathbf{4}_3$ and a longer crossbar 5 arranged perpendicular to the bars $\mathbf{4}_1$-$\mathbf{4}_3$, and by the outer walls $\mathbf{6}_1$-$\mathbf{6}_4$ of the suction head. Around the edges of all inlet sections 3; of the suction head are shown a number of primary jet nozzles $\mathbf{7}_i$. The primary jet nozzles are thus arranged partly on the outer walls $\mathbf{6}_i$ of the suction head and partly on the bars $\mathbf{4}_i$ and 5. In the uppermost part of FIG. 1 is shown a supply pipe 8 for pressurized water which is connected to suction head 1 via a swivel 9 and branched to each of the afore mentioned nozzles $\mathbf{7}_i$ by means of a number of smaller pressure water pipes. FIG. 1 also shows a suction hose 10 that over a joint 11 is connected to an opening 12 at the back f the suction head 1. Between the suction hose 10 and the supply pipe 8 is shown a controller arm 13 that is attached to the suction head 1 by a hinged connection 14. The illustration of this in FIG. 1 is somewhat simplified as the hinge 14 will normally comprise two separate axes that receives a supporting arm and a controller arm respectively, so that the suction head may be turned back and forth by hydraulically extending and contracting the controller arm relatively to the supporting arm.

In FIG. 1 the primary nozzles are shown with a fixed mutual distance. This may be a convenient arrangement, but is certainly not a requirement. Often it will be desirable that the primary nozzles $\mathbf{7}_i$ along the lowermost edge $\mathbf{6}_3$ of the suction head are small nozzles that are arranged very close to one another so that they cut a plane, smooth surface. Other of the primary nozzles may be larger and arranged at a larger mutual distance from one another.

A particularly "cutting" effect may be obtained by the primary nozzles 7; at the lowermost edge 63 if they are arranged with an inclination (not shown) compared to the normal direction of movement for the suction head 1 under work, said direction of movement being perpendicular or substantially perpendicular to the surface defined by the edges $\mathbf{6}_1$-$\mathbf{6}_4$ around the inlet opening. Denoting the walls or surfaces of the suction head that ends in the edges $\mathbf{6}_2$ and $\mathbf{6}_4$ respectively for the side walls of the suction head, the primary jet nozzles $\mathbf{7}_i$ positioned along lower edge $\mathbf{6}_3$ that are closer to edge $\mathbf{6}_2$ than to edge $\mathbf{6}_4$, may be angled away from the side wall comprising edge $\mathbf{6}_2$ and thus against the side wall comprising edge $\mathbf{6}_4$. Correspondingly may the primary jet nozzles $\mathbf{7}_i$ positioned along lower edge $\mathbf{6}_3$ that are closer to edge $\mathbf{6}_4$ than to edge $\mathbf{6}_2$, may be angled away from the side wall comprising edge $\mathbf{6}_4$ and thus against the side wall comprising edge $\mathbf{6}_2$. If said primary nozzles $\mathbf{7}_i$ are positioned in a common plane, the jets from same nozzles $\mathbf{7}_i$ along the edge $\mathbf{6}_3$ will describe a continuous surface when the suction head is moved forward in a linear manner. It is obvious that also the primary jet nozzles $\mathbf{7}_i$ along e.g. the upper edge $\mathbf{6}_1$ may be angled in a corresponding way.

Another way of obtaining such a cutting effect is by directing all of or some of the primary jet nozzles $\mathbf{7}_i$ downwardly inclined compared to an axis perpendicular to the inlet opening, e.g. with an inclination of 10 degrees or more compared to such an axis.

The suction head 1 may be furnished with mechanical means in the form of a partition wall 25 or the like to lead the solid particles in the direction of the outlet opening 12.

Figure 2:
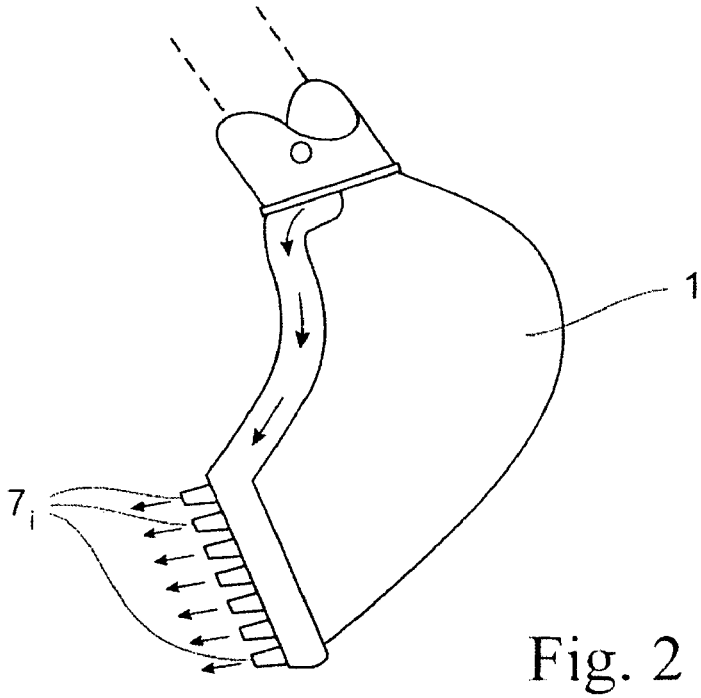
FIG. 2 is a side view of the suction head of FIG. 1.

FIG. 2 provides a side view of the suction head of FIG. 1. In FIG. 2 the nozzles 7 is seen integrated in or designed as teeth 16 extending from the edge 6 of the suction head. With "extending" is meant having a direction mainly perpendicular to the surface defined by the inlet opening 3 of the suction head 1. It should, however, be noted that even when the suction head 1 is provide with extending teeth 16, primary nozzles 7 may also or alternatively be arranged between such teeth. Not all primary nozzles 7 have to be uniformly oriented. A majority of the nozzles along the upper and lower edge may e.g. have a uniform orientation in order to provide parallel jets perpendicular to the inlet opening while every fourth or every fifth nozzle $\mathbf{7}_i$ at the upper edge $\mathbf{6}_1$ may have an orientation allowing these nozzles to provide downward inclined jets in front of the inlet opening while every fourth or fifth nozzle at the lower edge may have an orientation allowing these nozzles to provide upward inclined jets in front of the inlet opening.

Figure 3:
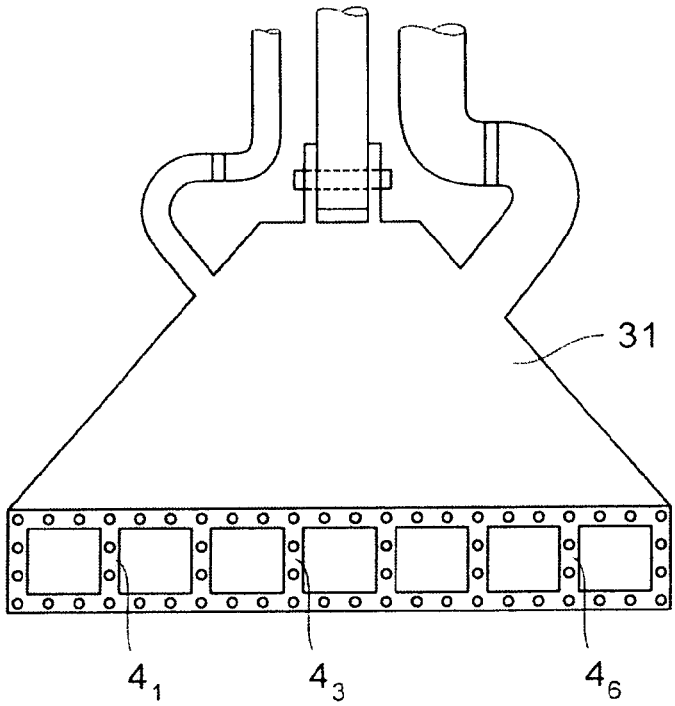
FIG. 3 is a front view of an alternative embodiment of an excavation and suction device according to the invention.

FIG. 3 shows an alternative embodiment of the device according to the invention, with the characterizing feature of a particularly wide suction head 31. On the other hand the height of the inlet opening is reduced so that the total area of the inlet opening does not become too large compared to the cross-section of the suction hose, which would have led to a low velocity through the inlet opening and a correspondingly low suction ability. As disclosed by FIG. 3 there are only bars $\mathbf{4}_1$-$\mathbf{4}_6$ in one direction, no crossbars horizontally.

Figure 4:
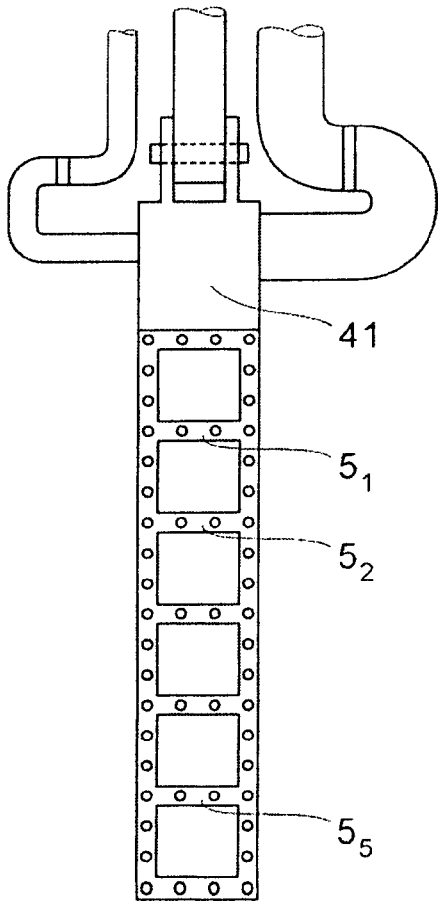
FIG. 4 is a front view of still another embodiment of an excavation and suction device according to the present invention.

FIG. 4 shows the "opposite" variant to FIG. 3, i.e. a particularly narrow suction head 41 that has a particularly large height. The width of this suction head may typically be adapted to a particular purpose, like the width of a ditch for a pipe to be embedded in the sea floor. FIG. 4 shows only horizontal bars and no vertical crossbars. The area of the inlet opening compared to the area of the suction head are of the same magnitude for all three embodiments shown in FIGS. 1, 3 and 4.

With all the three described embodiments of the invention the bars $\mathbf{4}_i$, $\mathbf{5}_i$ serve a double purpose. Firstly they constitute a grating that ensures that no particles with a least cross-sectional dimension larger than the cross-section of each inlet section $\mathbf{3}_i$ may be sucked into suction head 1. The bars thus have character of a filter. Secondly they have the more active character of constituting parts of a tool for hydraulic and mechanic disintegration of the sediment or bulk material that is to be moved.

The distance between the each bar $\mathbf{4}_i$ and $\mathbf{5}_i$ respectively is preferably chosen such that the cross-sectional area of any inlet opening $\mathbf{3}_i$ is less then, or at least not larger than, the cross-sectional area of the outlet opening 12 from the suction head.

In addition to the primary jet nozzles $\mathbf{7}_i$ that disintegrate material mainly outside the suction head 31, there may be arranged secondary jet nozzles to provide water jet streams mainly across the direction of movement for water and solid material through the suction head, thereby providing an additional disintegration of the material inside the suction head. Normally such secondary nozzles will be arranged in one or more rows across the direction of movement for the material through the suction head and preferably with at least one such row near the inlet opening.

One or more secondary jet nozzles may be arranged particularly in the vicinity of the outlet opening, to disintegrate any long and narrow particles that might pass through an inlet section and that due to its length might not be able to pass through the joint 11 where the suction hose is attached.

By any one of the discussed embodiments there may within the suction head be arranged nozzles that are directed mainly from the inlet opening towards the outlet opening to facilitate transportation of particles in said direction. Such nozzles may be denoted tertiary nozzles as their aim of facilitating transportation through the suction head is different from the aim of the primary and secondary nozzles, to disintegrate the material.

Figure 5A:
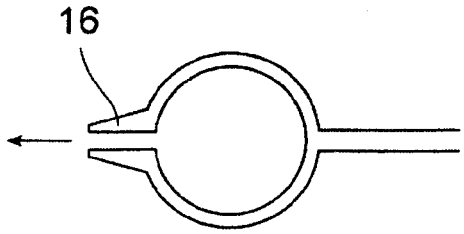
FIGS. 5*a*, 5*b* shows in magnification two variants of nozzles included in the device according to the invention.
Figure 5B:
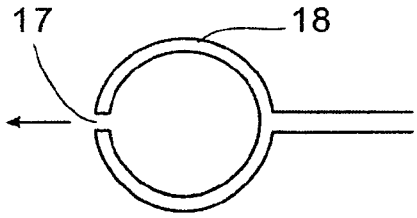
Figure 6:
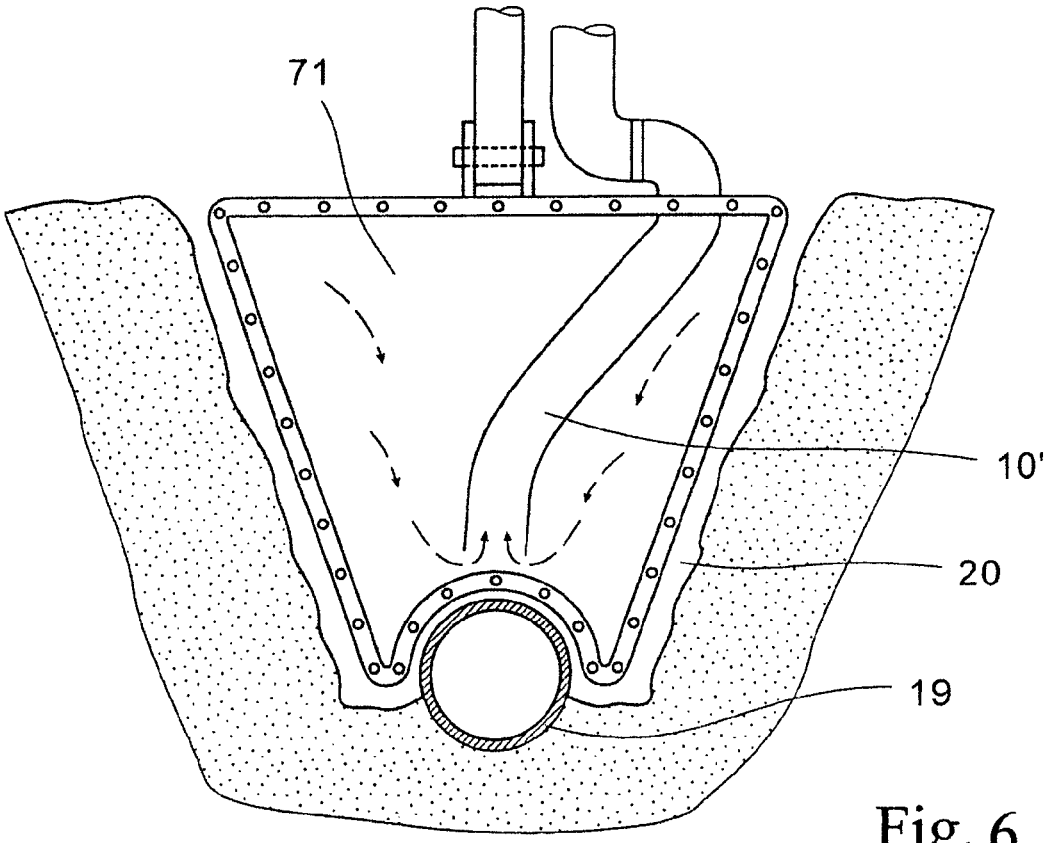
FIG. 6 is a side view of a fourth embodiment of an excavation and suction device according to the present invention.

FIGS. 5*a-b* show to variants of jet nozzles, as the variant of FIG. 6*a* comprises an extending wedge-like edge or correspondingly extending teeth 16, (continuously or discontinuously) in a direction perpendicular to the plane of the paper, while the variant according to FIG. 6*b* only have borings 17 (one shown) through the wall of a pressure water supply pipe 18 that in FIG. 6 extends mainly perpendicular to the paper plane. In the shown embodiments the profile of the pressure water supply pipe or pipes 18 are circular. There is, however, fully possible to use pipes with an oval profile which may also be preferable in order to let the pipes occupy as little space as possible in a certain direction within the suction head or to increase the rigidity of the pipes in a certain direction.

FIG. 6 shows a particular variant of a suction head 61 according to the invention, a suction head that is tailor made to recover a pipe 19 in a ditch 20 filled with loose clay or the like which is comparatively easy to remove. The inlet opening of suction head 41 (61?) comprises areas at several sides of the head and the cross-sectional area of the inlet opening is significantly larger than for more normal embodiments of the suction head. In addition the suction hose 10' is extended within the suction head in order to suck up material from the lower part of the suction head.

Figure 7:
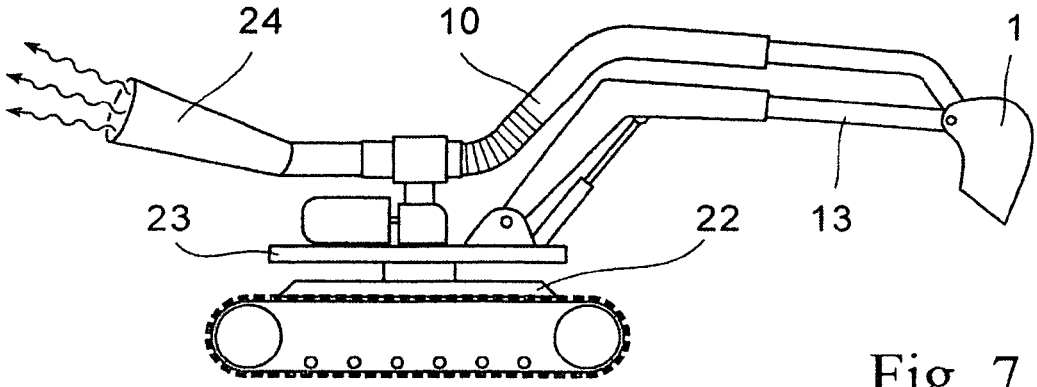
FIG. 7 is a side view of an assembly of a tool support (a chassis) and an excavation and suction device.

FIG. 7 shows an assembly in which the device according to the invention is mounted on or comprises a full track chassis 22. It is indicated that the device is mounted with a gear rim or similarly pivotal platform 23 in order to increase its reach and applicability. At the outlet end of suction hose 10, that has a substantially uniform cross-section throughout its length, a diffuser shaped pipe stub 24 contributing to a reduced loss in the hose is arranged. This is a preferred feature with the device according to the invention.

Figure 8:
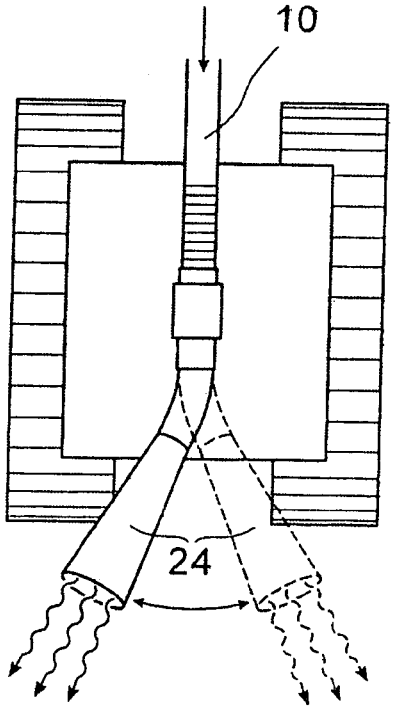
FIG. 8 is a top view of the assembly of FIG. 7.

FIG. 8 is a top view of the assembly of FIG. 7. In FIG. 8 is shown how the diffuser shaped pipe stub 24 may be pivoted between two or more different positions in order to obtain a greater versatility with respect to the direction with which the material is discharged. It is obvious that the feature shown in FIG. 9 may also be applied when the outlet pipe stub is not diffuser shaped.

The bars may be manufactured in many different shapes and materials. A particular kind of bar is one where the pressure water pipe as such is manufactured in a material, a thickness and with a profile suited to function as bars. It should be noted that it is not required that the pressure water pipes have a circular cross-section, such pipes can also have an oval cross-section, rhomb shaped cross-section, or other cross-sectional shapes so that they e.g. occupy less space in a certain direction or have a particular rigidity (flexural strength) in a certain direction. In general the pressure water pipes supplying water to the nozzles will be designed as part of the suction head and thereby contribute to rigidity and strength of the latter.

The orifice of the outlet opening 12 is typically rounded so that the frictional loss becomes as small as possible.

It is desirable in order to be able to work rapidly that the cross-section of the inlet opening is larger than the cross-section of the outlet opening. The ratio between these two areas should however not be too large. It is thus preferred that the ratio between these two areas is chosen such that the average water velocity through the inlet opening is at least 30% of the water velocity through the outlet opening, and more preferred at least 50% of the velocity through the outlet opening.

In order to further optimize the excavation and suction operation the suction head may have also a sideways movable joint (tilt or rotation) corresponding to the shovels used e.g. by landscape gardeners, and/or the controller arm may be furnished with a telescopic element so that the suction head may readily be moved along a straight line.

The suction head may be designed in a number of different ways according to the actual tasks. For leveling a suction head that is several meters wide but with a very low inlet opening, e.g. lower than 20 cm, may be used. On the other hand, for ditching or trenching a suction head that is quite narrow but very high may be applied. The ditch and thus the width of the suction head need not be significantly wider than the cable or pipe diameter. The suction hose 10 and the supply pipe 8 for pressurized water are connected to the suction head 1 in a flexible or hinged way in order to allow the suction head its desired freedom of movement. The connection may vary with different designs of the pattern of movement for the suction head. For a suction head that may be pivoted around an axis a swivel will typically be used. A flexible hose between the suction head and a rigid outlet pipe may be used as an alternative to the flexible suction hose 10. If the controller arm 13 comprises a telescopic element, also the outlet pipe 10 will typically comprise such a telescopic element in the same region.

The suction in the suction hose 10 may be set up by means of one or more ejector nozzles arranged outside the cross-section of the suction hose so that the cross-sectional area is constant. It may thus be avoided that rocks or other large objects get stuck. The outlet that preferably is localized behind a chassis or a tool support may be furnished with a diffuser (tapered extension) to save energy. It is furthermore an advantage if the outlet/diffuser as arranged in a way allowing it to be turned from side to side. By such an arrangement the direction of the material discharged may be controlled in relation to the direction of stream in the water so that the visibility is largely maintained. Typically the diameter of the suction hose will be in the range 200-350 mm.

When above stated that the suction hose 10 is connected to the outlet opening of suction head 1, it is still within the frame of the present invention that such suction hose is comprised by a rigid, hinged structure that possibly constitutes an integrated part of an ejector used to set up the desired suction in the suction head.

It is furthermore implied that the source for pressurized water may be either a reservoir that is under pressure or water that is pressurized by means of a suitable pump when transported from the reservoir to the nozzles.

The invention claimed is:

1. Subsea excavation and suction device for complete submersion comprising a suction head movably attached to a hydraulic controller arm and having an inlet opening at a free, outer end and an outlet opening attached to a suction hose arranged at a distance from the inlet opening, said suction head having means for disintegration solid material and having a larger cross-sectional area at the inlet opening than at the outlet opening, the suction head comprising both hydraulic and mechanical means to disintegrate solid material, the hydraulic means comprising a plurality of primary jet nozzles arranged along at least one edge surrounding the inlet opening and having fluid communication with a source of pressurized liquid, and the mechanical means comprising at least one bar dividing the inlet opening into inlet sections, said at least one bar being shaped and dimensioned to effect a mechanic disintegration of solid sediment material.

2. Device as claimed in claim 1, wherein at least one inlet opening edge is shaped and dimensioned to mechanically disintegrate solid material.

3. Device as claimed in claim 2, wherein all said inlet opening edges are shaped and dimensioned to mechanically disintegrate solid material.

4. Device as claimed in claim 1, wherein the plurality of the primary jet nozzles are arranged to purge in a direction substantially straight ahead from the inlet opening, in a direction substantially opposite to the direction of movement of sediment material being sucked into the inlet opening.

5. Device as claimed in claim 4, wherein the plurality of the primary jet nozzles are arranged parallel with each other and arranged sufficiently close to one another that a substantially smooth cutting edge in the sediment is obtained during use.

6. Device as claimed in claim 5, wherein a plurality of secondary jet nozzles are arranged within the suction head to further disintegration of sediment material, said secondary jet nozzles having fluid connection with a pressurized liquid and being arranged substantially perpendicular to the direction of movement for the sediment being sucked into the inlet opening.

7. Device as claimed in claim 6, wherein at least two of the primary and/or secondary jet nozzles comprise holes bored along a line in parts of a supply pipe for liquid from the pressurized liquid source.

8. Device as claimed in claim 7, wherein at least two of the primary jet nozzles are arranged in wedge-like teeth that extend from around the inlet opening of the suction head.

9. Device as claimed in claim 7, wherein at least two of the primary jet nozzles are arranged in a wedge-like edge that extends from around the inlet opening of the suction head.

10. Device as claimed in claim 1, wherein at least two of the bars are provided with primary jet nozzles.

11. Device as claimed in claim 1, wherein the inlet sections have a cross-sectional area substantially equal to and not larger than a cross-sectional area of the outlet opening.

12. Device as claimed in claim 1, wherein said bars divide the inlet opening of the suction head into sections in a grid pattern in one direction.

13. Device as claimed in claim 1, wherein said bars divide the inlet opening of the suction head into sections in a grid pattern in two directions.

14. Device as claimed in claim 1, additionally comprising secondary nozzles for proving jet streams substantially across a direction of movement of solid material being sucked into suction head arranged near the outlet opening in the suction head.

15. Device as claimed in claim 1, additionally comprising a backflush nozzle arranged near the outlet opening in order to temporarily reverse direction of transportation trough the suction hose.

16. Device as claimed in claim 1, wherein the suction hose is provided with a sideways opening or valve that opens at a predetermined underpressure, such that the suction force and thereby the risk of clogging is reduced.

17. Device as claimed in claim 1, wherein the inlet opening of the suction head has a cross-sectional area selected such that average water velocity through inlet opening is at least 30% of water velocity through outlet opening.

18. Device as claimed in claim 17, wherein the inlet opening of the suction head has a cross-sectional area selected such that the average water velocity through inlet opening is at least 50% of the water velocity through outlet opening.

19. Device as claimed in claim 1, wherein the hydraulic controller arm comprises an outer telescopic arm for linearly conveying the suction head.

20. Device as claimed in claim 1, wherein the hydraulic controller arm has a movability that allows the suction head to be moved sideways or rotated.

21. Device as claimed in claim 1, wherein suction force in the suction head is provided by means of an ejector with one or more ejector nozzles arranged angularly outside the cross-section of the suction hose.

22. Device as claimed in claim 1, wherein the device is mounted on or comprises a full track chassis.

23. Device as claimed in claim 22, wherein the chassis comprises a platform which is pivotal about a gear rim.

* * * * *